US007972118B2

(12) United States Patent
Hirabayashi et al.

(10) Patent No.: US 7,972,118 B2
(45) Date of Patent: Jul. 5, 2011

(54) VARIABLE CAPACITY COMPRESSOR

(75) Inventors: Yuichi Hirabayashi, Kuki (JP); Keigo Usui, Gunma (JP)

(73) Assignee: Calsonic Kansei Corporation, Tokyo (JP)

( * ) Notice: Subject to any disclaimer, the term of this patent is extended or adjusted under 35 U.S.C. 154(b) by 724 days.

(21) Appl. No.: 12/089,689

(22) PCT Filed: Oct. 11, 2006

(86) PCT No.: PCT/JP2006/320309

§ 371 (c)(1),
(2), (4) Date: Apr. 9, 2008

(87) PCT Pub. No.: WO2007/043574

PCT Pub. Date: Apr. 19, 2007

(65) Prior Publication Data

US 2009/0047145 A1 Feb. 19, 2009

(30) Foreign Application Priority Data

Oct. 12, 2005 (JP) ..... 2005-298093

(51) Int. Cl.
*F04B 1/12* (2006.01)

(52) U.S. Cl. ..... 417/269; 92/12.2

(58) Field of Classification Search ..... 417/269, 417/222.2, 222.1; 92/12.2, 71; 91/505; 74/839
See application file for complete search history.

(56) References Cited

U.S. PATENT DOCUMENTS

| | | | | |
|---|---|---|---|---|
| 2005/0180860 | A1* | 8/2005 | Dewispelaere et al. | 417/269 |
| 2007/0101859 | A1* | 5/2007 | Nadamoto et al. | 92/71 |
| 2007/0220859 | A1 | 9/2007 | Kubo et al. | |

FOREIGN PATENT DOCUMENTS

| | | | |
|---|---|---|---|
| EP | 1 445 486 | A1 | 8/2004 |
| JP | 10-176658 | A | 6/1998 |
| JP | 2005-083325 | A | 3/2005 |
| WO | WO 2005/100790 | A1 | 10/2005 |

* cited by examiner

*Primary Examiner* — Charles G Freay
*Assistant Examiner* — Todd D Jacobs
(74) *Attorney, Agent, or Firm* — Foley & Lardner LLP

(57) ABSTRACT

The first maximum inclination angle θ1 is a maximum inclination angle of a link member 45 allowed by a clearance between a slit 41*s* of a rotor 21 and one end 45*a* of the link member 45; the second maximum inclination angle θ2 is a maximum inclination angle of the link member 45 allowed by a clearance between a slit 43*s* of a swash plate 24 and the other end 45*b* of the link member 45; the third maximum inclination angle θ3 is a maximum inclination angle of a first linking pin 46 allowed by a clearance between the first linking pin 46 and a first bearing hole 41*a*; the fourth maximum inclination angle θ4 is a maximum inclination angle of a second linking pin 47 allowed by a clearance between the second linking pin 47 and a second bearing hole 43*a*; and the fifth maximum inclination angle θ5 is a maximum inclination angle of the swash plate 24 with respect to the drive shaft 10 allowed by a clearance between the drive shaft 10 and a pair of the tilting guide faces 37, 37. Relations (θ3+θ4)<θ5<θ1, θ2 are established.

1 Claim, 16 Drawing Sheets

(a)

(b)

$(\theta 3+\theta 4) < \theta 5 < \theta 1, \theta 2$ $(\theta 3+\theta 4) < \theta 5 < \theta 1, \theta 2$ $\theta 1, \theta 2 < \theta 3, \theta 4, \theta 5$ $\theta 5 < \theta 1, \theta 2, (\theta 3+\theta 4)$

VARIABLE CAPACITY COMPRESSOR

TECHNICAL FIELD

The present invention relates to a variable capacity compressor.

BACKGROUND ART

A conventional variable capacity compressor includes a drive shaft, a rotor fixed to the drive shaft to rotate integrally with the drive shaft, a swash plate which is tiltably attached to the drive shaft, and a link mechanism provided between the rotor and the swash plate (see, for example, Japanese Patent Application Laid-Open Publication No. 10-176658). The link mechanism permits the inclination angle of the swash plate to change while transferring torque from the rotor to the swash plate. When the inclination angle of the swash plate is changed, strokes of pistons are changed so that discharge rate of the compressor is changed.

FIG. 17 is a view of a link mechanism disclosed in Publication No. 10-176658.

The link mechanism in FIG. 17 includes a pair of rotor arms 145, 146 which extend from a rotor 140 toward a swash plate 141 and face to each other, a single swash plate arm 147 which extends from the swash plate 141 toward the rotor 140, and a pair of link arms 142A, 142B. These five arms 145, 142A, 147, 142B, and 146 are stacked in the torque transfer direction so that rotation of the rotor 140 is transferred to the swash plate 141. Each of the link arms 142A, 142B has a first end which is linked to the rotor arms 145, 146 by a first linking pin 143 and a second end which is linked to the swash plate arm 147 by a second linking pin 144. With this structure, the link arms 142A, 142B are rotatable about the first linking pin 143 with respect to the rotor arms 145, 146, and the swash arm 147 is rotatable about the second linking pin 144 with respect to the link arms 142A, 142B, so that the inclination angle of the swash plate 141 with respect to a drive shaft (not shown) is changeable.

DISCLOSURE OF THE INVENTION

When the compressor is operative (When the drive shaft rotates), contact surfaces between the rotor arm 145 and the link arm 142A and contact surfaces between the link arm 142A and the swash plate arm 147 function as torque transferring surfaces and also as rotary sliding surfaces. In other words, the rotor arm 145 and the link arm 142A rotationally slide with respect to one another under a large pressure of the torque. The link arm 142A and the swash plate arm 147 also rotationally slide with respect to one another under a large pressure of the torque Ft. Accordingly, when the inclination angle of the swash plate 141 is changed, the sliding friction at the contact between the rotor arm 145 and the link arm 142A becomes extremely high and the sliding friction at the contact between the link arm 142A and the swash plate arm 147 also becomes extremely high.

When the compressor is operative (When the drive shaft rotates), the swash plate 141 receives a large compression reaction force Fp from the pistons that are connected to the swash plate 141. As shown in FIG. 17 (also see FIG. 6), since the compression reaction force Fp is applied to the positions anterior to the link mechanism in the rotating direction, the swash plate 141 leans in a direction different from its inclination direction guided by the link mechanism, so that torsion load is given to the swash plate arms 147 in the Y direction in the figure. Accordingly, the link 142 is pressed against the swash plate 141 at two points (C, C) to become wedged and this causes a further increased sliding friction.

The above problem can occur in a variable capacity compressor in that a swash plate is attached to a drive shaft via a sleeve and also in a no-sleeve type variable capacity compressor in that a swash plate is directly attached to a drive shaft.

The present invention is provided to solve the problem. An object of the present invention is to provide a no-sleeve type variable capacity compressor capable of preventing an increased sliding friction caused by torsion load.

An aspect of the present invention is to provide a variable capacity compressor. The variable capacity compressor includes: a drive shaft; a rotating member fixed to the drive shaft and configured to rotate integrally with the drive shaft; a tilting member having a tilting guide hole formed with a pair of opposite tilting guide faces and tiltably attached to the drive shaft; a link mechanism configured to transfer a rotary torque of the rotating member to the tilting member as allowing the tilting member to tilt; and a piston configured to reciprocate in response to rotation of the tilting member. The link mechanism includes: a pair of opposite arms extending from the rotating member toward the tilting member; a pair of opposite arms extending from the tilting member toward the rotating member; a link member having a first end that is inserted between the arms of the rotating member and a second end that is inserted between the arms of the tilting member, a first linking pin pivotally connecting the first end of the link member and the arms of the rotating member; and a second linking pin pivotally connecting the second end of the link member and the arms of the tilting member. Each of a first maximum inclination angle and a second maximum inclination angle is larger than a fifth maximum inclination angle, and the fifth maximum inclination angle is larger than a sum of a third maximum inclination angle and a fourth maximum inclination angle. The first maximum inclination angle is a maximum angle of the first end of the link member between the pair of the arms of the rotating member in pre-assembled condition, the second maximum inclination angle is a maximum angle of the second end of the link member between the pair of the arm of the tilting member in pre-assembled condition, the third maximum inclination angle is a maximum angle of the first linking pin in a bearing clearance in a bearing hole for the first linking pin in pre-assembled condition, the fourth maximum inclination angle is a maximum angle of the second linking pin in a bearing clearance in a bearing hole for the second linking pin in pre-assembled condition, and the fifth maximum inclination angle is a maximum angle of the drive shaft between the pair of the opposite tilting guide surfaces in pre-assembled condition.

According to the present invention, when the swash plate receives a compression reaction force and leans out of its inclination direction, the first linking pin leans to and contacts with an inner face of the bearing hole at two points and the second linking pin leans to and contacts with an inner face of the bearing hole at two points, so as to receive the compression reaction force that applied to the swash plate. With this structure, the link member is not pressed against the pair of the arms of the rotating member at two points and against the pair of the arms of the tilting member at two points so as not to be in a wedged state. This prevents such a wedged state causing an increased sliding friction, so that the controllability of the compressor is improved.

When an excessive compression reaction force, which is greater than a predetermined value, is applied to the swash plate, the first linking pin contacts with two points on the inner face of the bearing hole and the second linking pin contacts with two points on the inner faces of the bearing hole, and also a flexure is caused in at least one of the members constituting the link mechanism (at least one of the pair of arms of the rotating member, the pair of arms of the tilting member, the link member, the first linking pin, and the second linking pin), so that the degree of the incarnation of the tilting member further increases.

In this case, the compression reaction force can be supportively received in the tilting guide hole since the drive shaft contacts with two points on the pair of tilting guide faces in the tilting guide hole before the link member contacts with two points on the pair of arms of the tilting member and the pair of the arms of the rotating member. The link member is thus prevented from contacting with the pair of arms at two points even when an excessive compression reaction force, which is greater than a predetermined value, is applied. This prevents the link member from becoming wedged, so that the high controllability of the compressor is maintained.

When the drive shaft secondary (supportively) contacts with two points on the pair of tilting guide faces, most of the compression reaction force is received by the linking pins and bearing holes, so the controllability is hardly affected.

BEST MODE FOR CARRYING OUT THE INVENTION

A variable capacity compressor of an embodiment of the present invention will be described with reference to the accompanying drawings.

Figure 1:
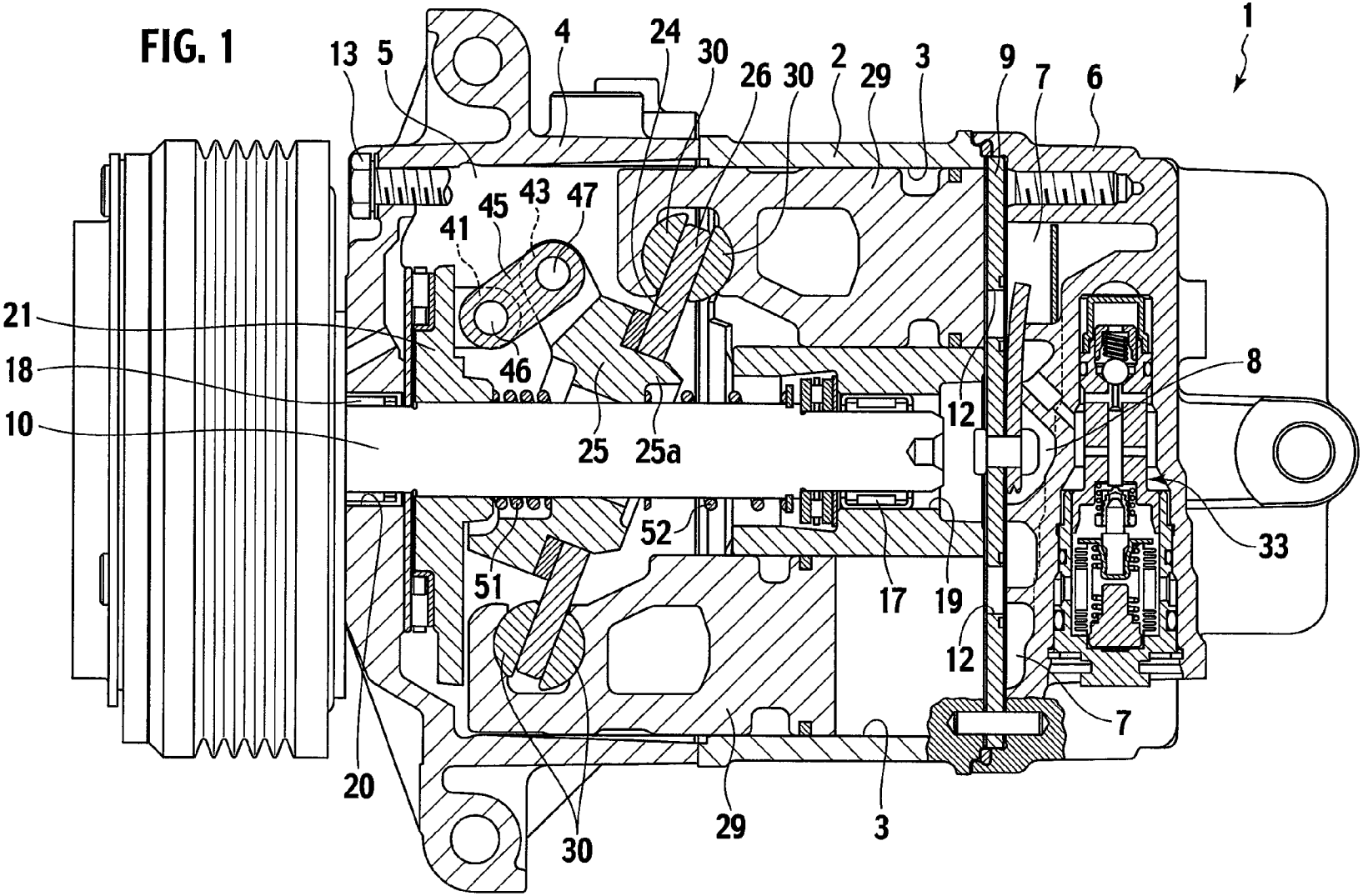
FIG. 1 is a cross-sectional view of a variable capacity compressor of an embodiment according to the present invention.
Figure 2:
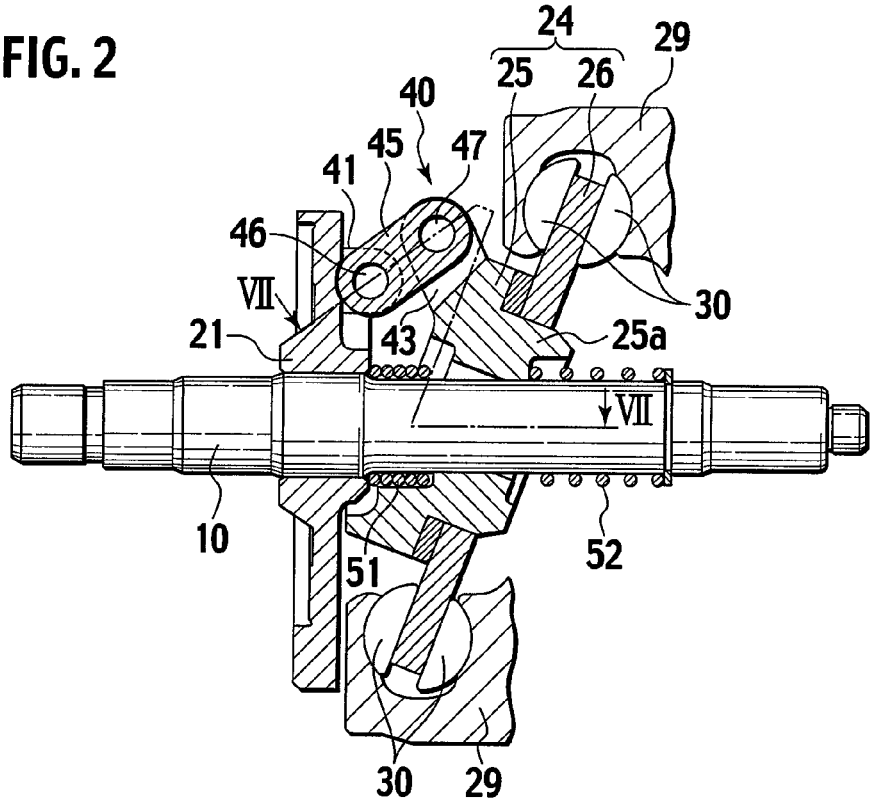
FIG. 2 is a partial cross sectional view of the variable capacity compressor having a swash plate in a full stroke condition.
Figure 3:
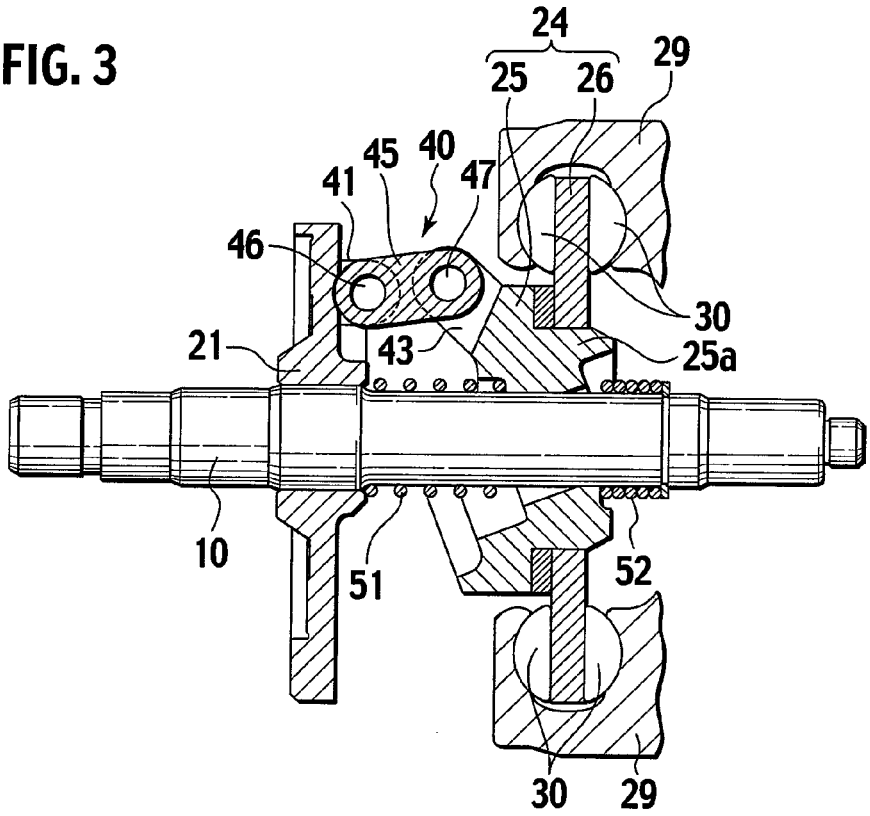
FIG. 3 is a partial cross sectional view of the variable capacity compressor having the swash plate in a no-stroke condition.

FIG. 1 is a cross-sectional view of the entire variable capacity compressor, FIG. 2 shows an inclination of a swash plate in a full stroke condition, and FIG. 3 shows an inclination of the swash plate in a no-stroke condition.

As shown in FIG. 1, the variable capacity compressor 1 includes a cylinder block 2 having a plurality of cylinder bores 3 (FIG. 2) placed evenly spaced apart in a circumferential direction, a front housing 4 attached to a front end of the cylinder block 2 and having a crank chamber 5 therein, and a rear housing 6 attached to a rear end of the cylinder block 2 via a valve plate 9 and having a suction chamber 7 and a discharge chamber 8 therein. The cylinder block 2, the front housing 4, and the rear housing 6 are fixedly connected to one another by a plurality of bolts 13 so as to make up a housing of the compressor.

The valve plate 9 is formed with suction ports (not shown) that communicate the cylinder bores 3 with the suction chamber 7, and discharge ports 12 that communicate the cylinder bore 3 with the discharge chamber 8.

A valve system (not shown) adapted to open or close the suction ports is provided on the valve plate 9 at the cylinder block side. A valve system (not shown) adapted to open or close the discharge ports 12 is provided on the valve plate 9 at the rear housing side. A gasket is interposed between the valve plate 9 and the rear housing 6 to maintain airtightness between the suction chamber 7 and the discharge chamber 8.

A drive shaft 10 is rotatably supported by radial bearings 17, 18 in support holes 19, 20 that are formed at the center portions of the cylinder block 2 and the front housing 4, respectively. With this structure, the drive shaft 10 is rotatable in the crank chamber 5.

The crank chamber 5 accommodates a rotor 21 acting as a "rotating member" fixed to the drive shaft 10, and a swash plate 24 acting as a "tilting member" tiltably and axially slidably attached to the drive shaft 10. In this embodiment, the swash plate 24 includes a hub 25 attached to the drive shaft 10, and a swash plate body 26 fixed to a boss segment 25*a* of the hub 25.

Each of the pistons 29 is slidably contained in the cylinder bore 3 and engaged with the swash plate 24 via a pair of hemispherical-shaped shoes 30, 30.

Between the rotor 21 as the rotating member and the hub 25 of the swash plate 24 as the tilting member, a link mechanism 40 is provided. The link mechanism 40 transfers rotary torque from the rotor 21 to the swash plate 24 as allowing changes in the inclination angle of the swash plate 24. The link mechanism 40 will be described in detail later.

The inclination angle of the swash plate 24 reduces when the swash plate 24 moves toward the cylinder block 2 (see FIG. 3). On the other hand, the inclination angle of the swash plate 24 increases when the swash plate 24 moves away from the cylinder block 2 (see FIG. 2).

When the drive shaft 10 rotates, the rotor 21 rotates integrally with the drive shaft 10. The rotation of the rotor 21 is transferred to the swash plate 24 via the link mechanism 40. The rotation of the swash plate 24 is converted into a reciprocating movement of the pistons 29 so that the pistons 29 reciprocate in the cylinder bores 3. By the reciprocating movements of the pistons 29, refrigerant is sucked from the suction chamber 7 into the cylinder bores 3 through the suction ports of the valve plate 9, compressed in the cylinder bores 3, and discharged to the discharge chamber 8 through the discharge ports 12 of the valve plate 9.

Variable Capacity Control

The variable capacity compressor is provided with a pressure control mechanism.

The pressure control mechanism controls pressure difference (pressure balancing) between the crank chamber pressure Pc in back of the piston 29 and the suction chamber pressure Ps in front of the piston 29 so as to change the inclination angle of the swash plate 24 to change the piston strokes. When changing the piston strokes, the amount of the discharge capacity of the compressor changes. The pressure control mechanism includes an extraction passage (not shown) that connects the crank chamber 5 with the suction chamber 7 to communicate one another, a supply passage (not shown) that connects the crank chamber 5 with the discharge chamber 8 to communicate one another, and a control valve 33 that is provided in the midstream of the supply passage to open and close the supply passage.

Tilting Guide Hole of Swash Plate

Figure 4:
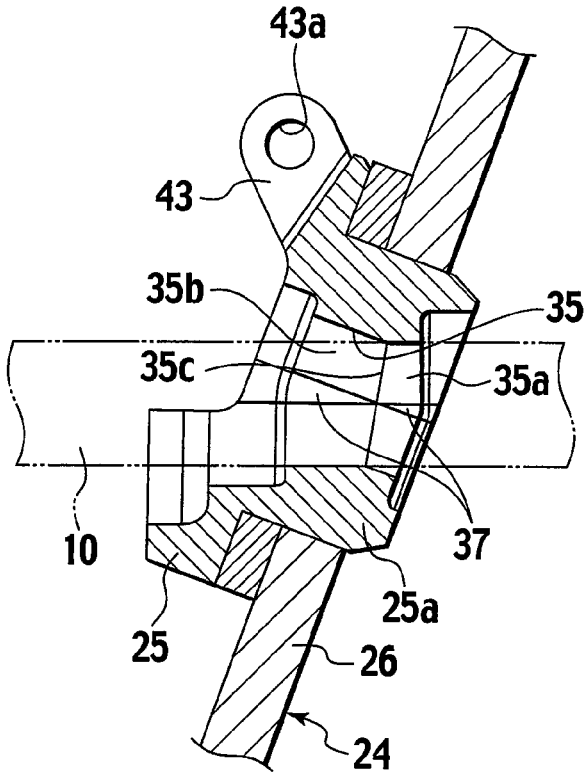
FIGS. 4(*a*) and 4(*b*) are cross sectional views showing a relation between a drive shaft and a tilting guide hole of the swash plate in the variable displacement compressor, wherein FIG. 4(*a*) shows the swash plate in a maximum inclination angle and FIG. 4(*b*) shows the swash plate in a minimum inclination angle.
Figure 4:
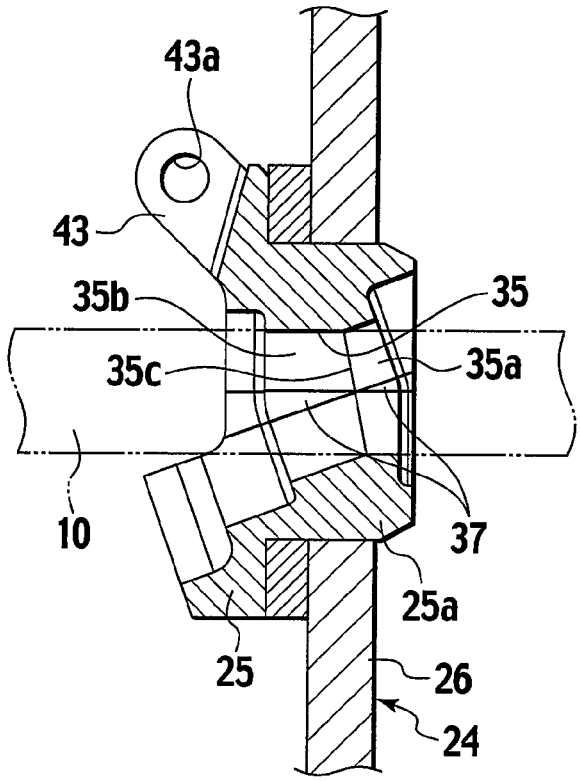
Figure 5:
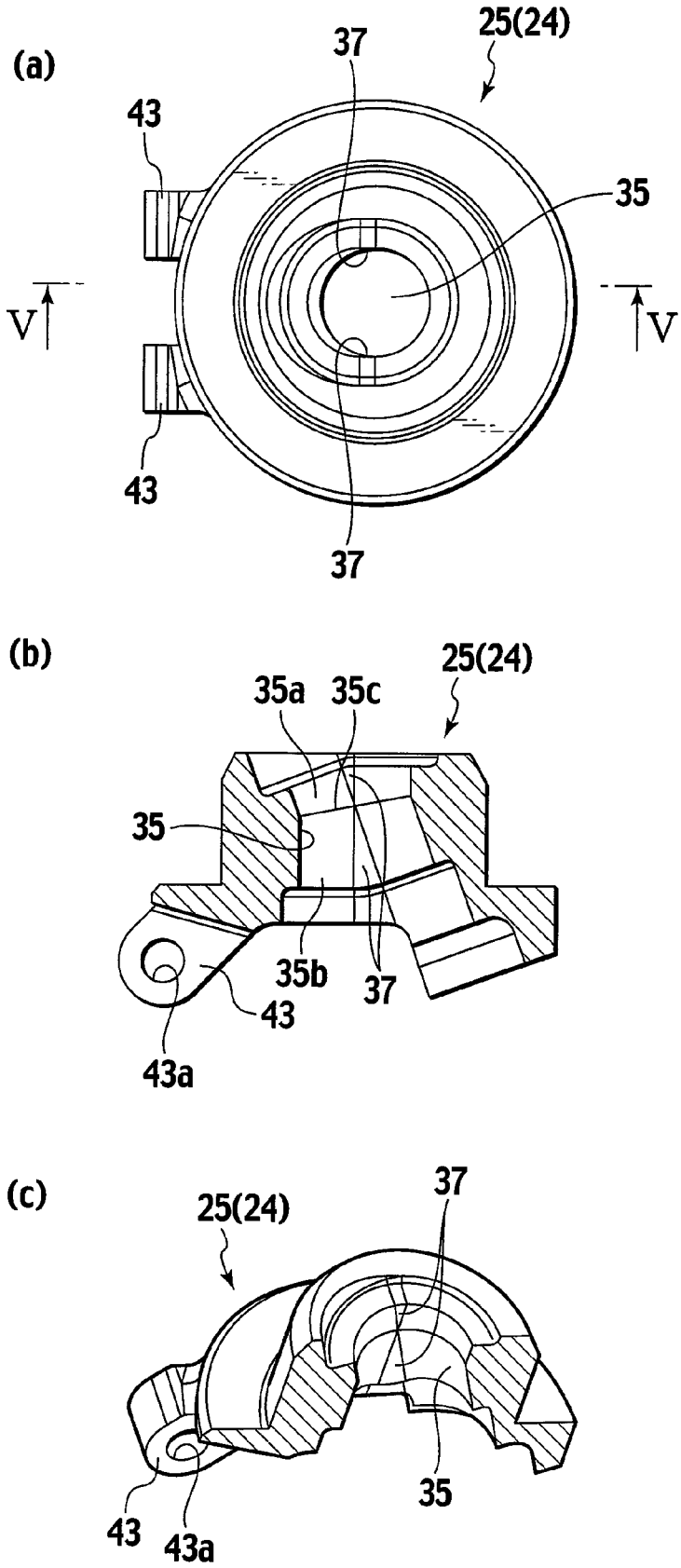
FIGS. 5(*a*), 5(*b*), and 5(*c*) are views of a hub of the swash plate, wherein FIG. 5(*a*) is a plane view of the hub, FIG. 5 (*b*) is a sectional view of the hub along a line V-V in FIG. 5(*a*), and FIG. 5(*c*) is a perspective view of the hub having a cross section along a line V-V in FIG. 5(*a*)

Next, an attachment structure in which the swash plate is attached to the shaft will be explained with reference to FIGS. 4 and 5. FIGS. 4(*a*) and 4(*b*) are cross sectional views showing a relation between the drive shaft and tilting guide faces of the swash plate, wherein FIG. 4(*a*) shows the swash plate in a maximum inclination angle position, and FIG. 4(*b*) shows the swash plate in a minimum inclination angle position. FIGS. 5(*a*), 5(*b*), and 5(*c*) are views of the hub of the swash plate, wherein FIG. 5(*a*) is a plane view of the hub, FIG. 5(*b*) is a sectional view of the hub along a line V-V in FIG. 5(*a*), and FIG. 5(*c*) is a perspective view of the hub having a cross section along a line V-V in FIG. 5(*a*).

As shown in FIGS. 4 (*a*) and 4(*b*), the swash plate 24 is attached to the drive shaft 10 such that the drive shaft 10 extends through the tilting guide hole 35. The tilting guide hole 35 is formed with a front opening 35*a* and a rear opening 35*b* on the both sides of a constricted portion 35*c* that has a minimum diameter. Each of the front opening 35*a* and the rear opening 35*b* is formed in an oval cross sectional shape. The major axes of the front opening 35*a* and the rear opening 35 are gradually lengthened out from the constricted portion 35*c* toward the respective opening ends thereof. As shown in FIG. 5(*a*), an inner face of the tilting guide hole 35 includes a pair of tilting guide faces 37 and 37 that are opposed one another. Along the tilting guide faces 37 and 37, the swash plate 24 tilts with respect to the drive shaft 10 (see FIGS. 4(*a*) and 4(*b*)).

Link Mechanism

Next, the link mechanism 40 will be explained with reference to FIGS. 6 to 14.

Figure 6:
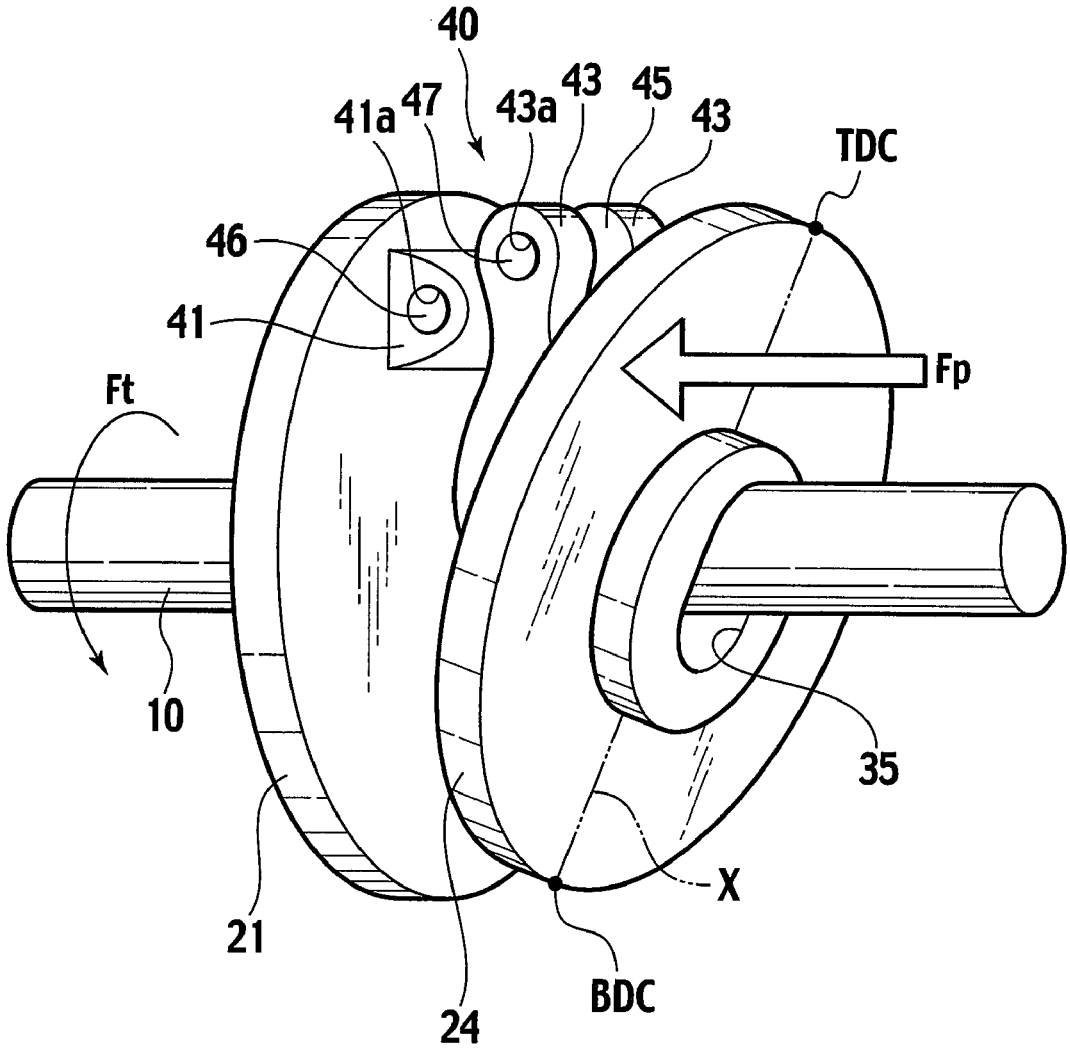
FIG. 6 is a diagrammatic perspective view of an assembly of the driving shaft, the swash plate, and a rotor that are assembled via a link mechanism.
Figure 7:
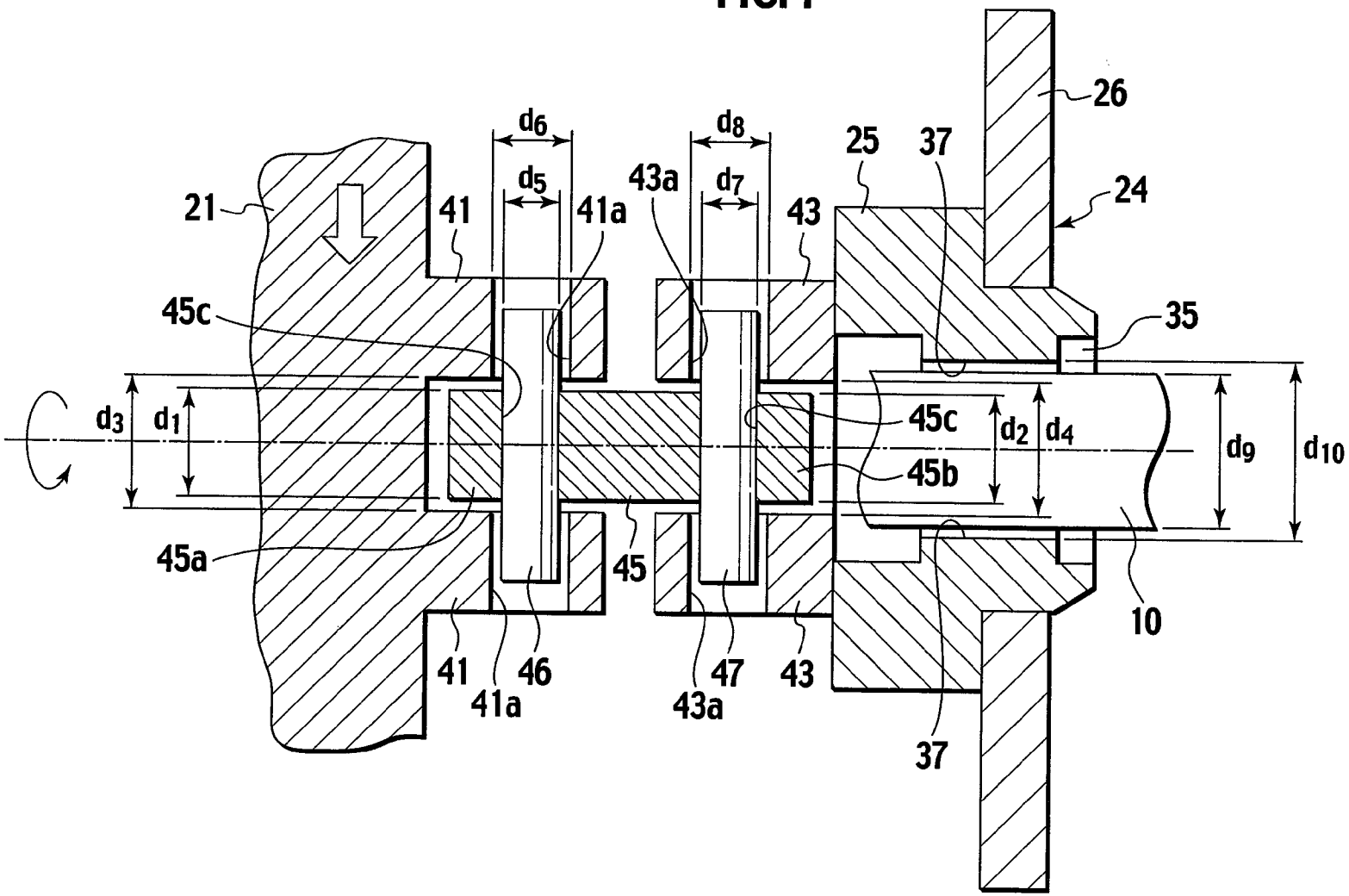
FIG. 7 is a cross sectional view of the link mechanism along a line VII-VII in FIG. 2.

Firstly, the structure of the link mechanism will be explained with reference to FIGS. 6 and 7. FIG. 6 is a diagrammatic perspective view of an assembly of the driving shaft, the swash plate, and a rotor that are assembled via a link mechanism. FIG. 7 is a cross sectional view of the link mechanism along the line VII-VII in FIG. 2.

As shown in FIGS. 6 and 7, the link mechanism 40 includes a pair of arms 41 and 41 which extend from the rotor 21 toward the swash plate 24 and are opposed each other across a slit 41*s*, a pair of arms 43 and 43 which extend from the swash plate 24 toward the rotor 21 and are opposed each other across a slit 43*s*, and a link member 45 inserted in the slit 41*s* of the rotor 21 (that is, a slit between the pair of arms 41, 41) and in the slit 43*s* of the swash plate 43*s* (that is, a slit between the pair of arms 43, 43). The pairs of arms 41, 41, 43, 43 are respectively arranged to opposite each other in a direction perpendicular to the drive shaft 10, that is, a rotation direction or a rotating torque transferring direction.

One end 45*a* of the link member 45 is rotatably connected to the pair of arms 41, 41 of the rotor 21 by a first coupling pin 46 which extends perpendicular to the drive shaft 10. The other end 45*b* of the link member 45 is rotatably connected to the pair of arms 43, 43 of the swash plate 24 by a second coupling pin 47 which extends perpendicular to the drive shaft.

As shown in FIG. 7, each of the pair of arms 41, 41 of the rotor 21 is formed with a first bearing hole 41*a* witch is configured to rotatably support the first coupling pin 46, and the one end 45*a* of the link member 45 is formed with a stationary hole 45*c* to which the first coupling pin 46 is press fitted to be fixed with the arms 41, 41. The pair of arms 43, 43 of the swash plate 24 is formed with a second bearing hole 43*a* witch is configured to rotatably support the second coupling pin 47, and the other end 45*b* of the link member 45 is formed with a stationary hole 45*d* to which the second coupling pin 47 is press fitted to be fixed with the arms 43, 43. The first coupling pin 46 and the second coupling pin 47 are made to have the same length and the same diameter.

The width d3 of the slit 41*s* of the rotor 21, that is, the distance between the pair of the arms 41, 41 of the rotor 21, and the width d4 of the silt 43*s* of the swash plate 24, that is, the distance between the pair of arms 43, 43 of the swash plate 24 are the same length. The link member 45 is formed in a rectangular shape and its outside faces are formed entirely flat without any steps. With this structure, the width d1 of the one end 45*a* of the link member and the width d2 of the other end 45*b* of the link member are the same.

Next, a relationship of link mechanism components in pre-assembled condition will be described with reference to FIGS. 8 to 12.

Figure 8:
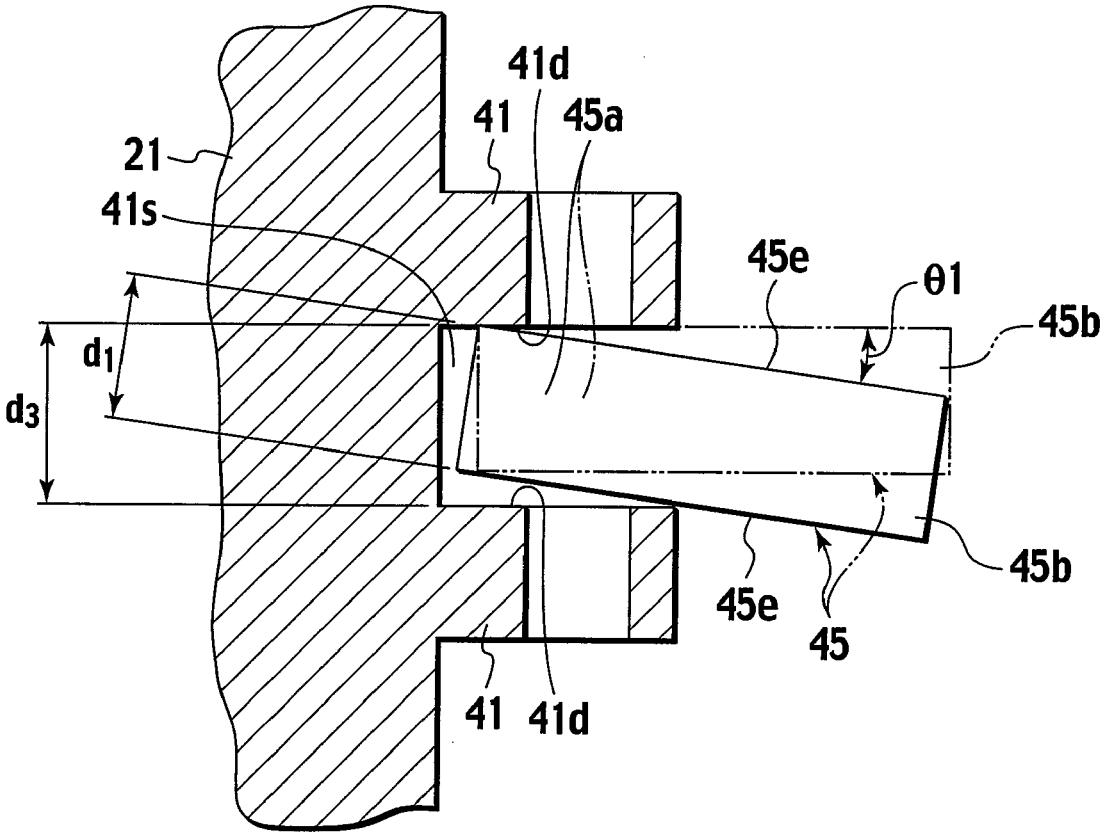
FIG. 8 is an explanatory view showing a maximum inclination angle θ1 of a first end of a link member in a clearance between a pair of arms of the rotor.
Figure 9:
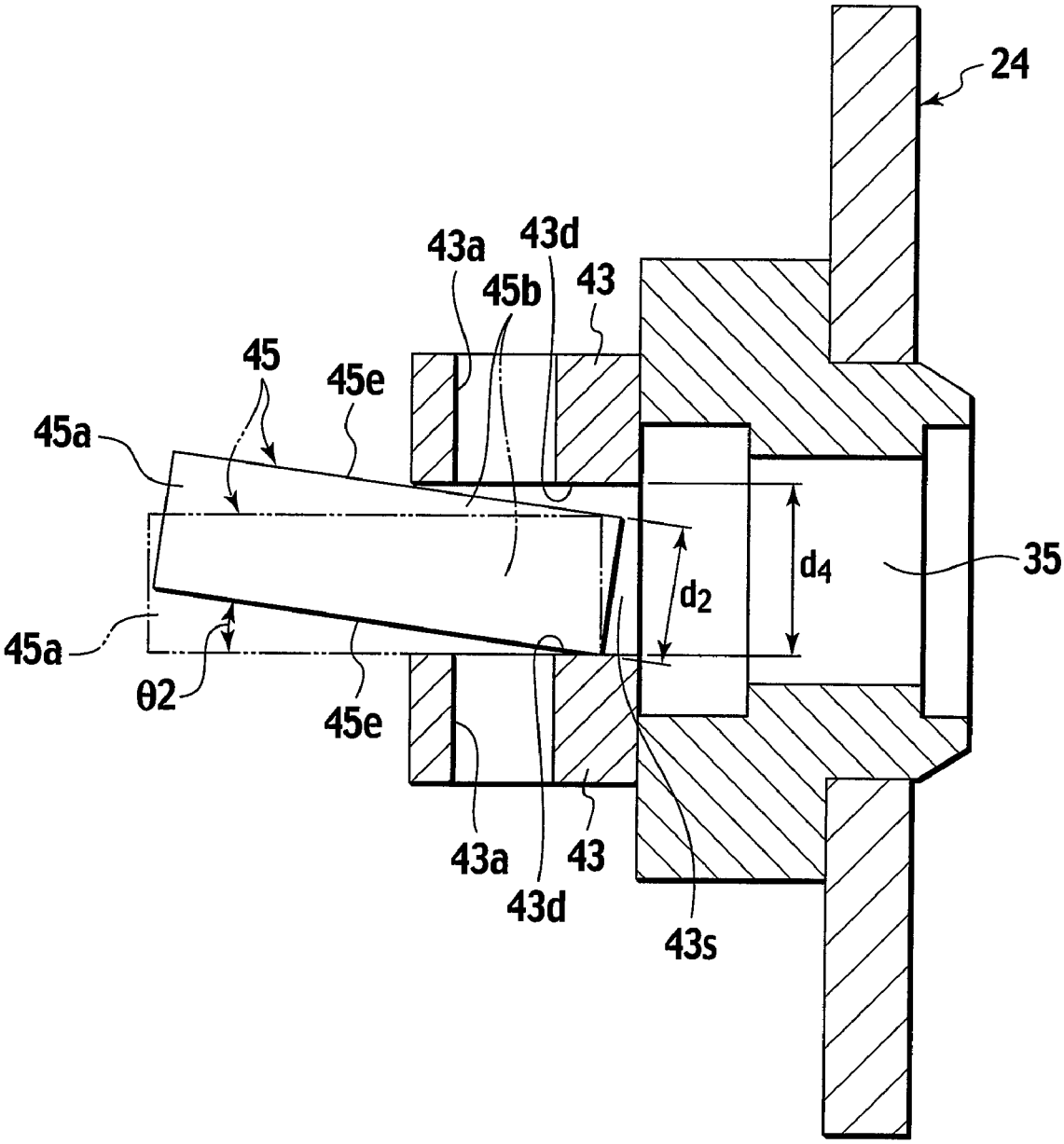
FIG. 9 is an explanatory view showing a maximum inclination angle θ2 of a second end of the link member in a clearance between a pair of arms of the swash plate.
Figure 10:
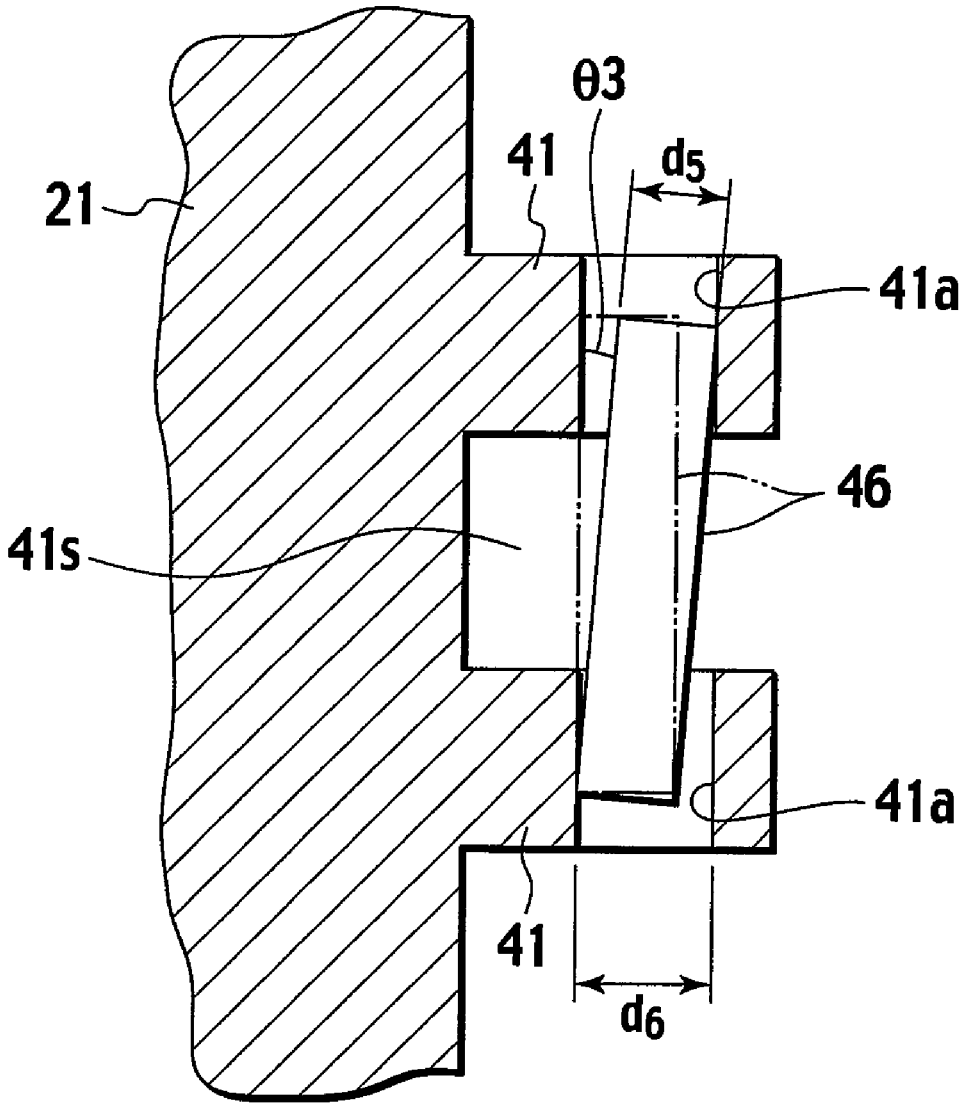
FIG. 10 is an explanatory view showing a maximum inclination angle θ3 of a first linking pin in a bearing clearance in a bearing hole for the first linking pin.
Figure 11:
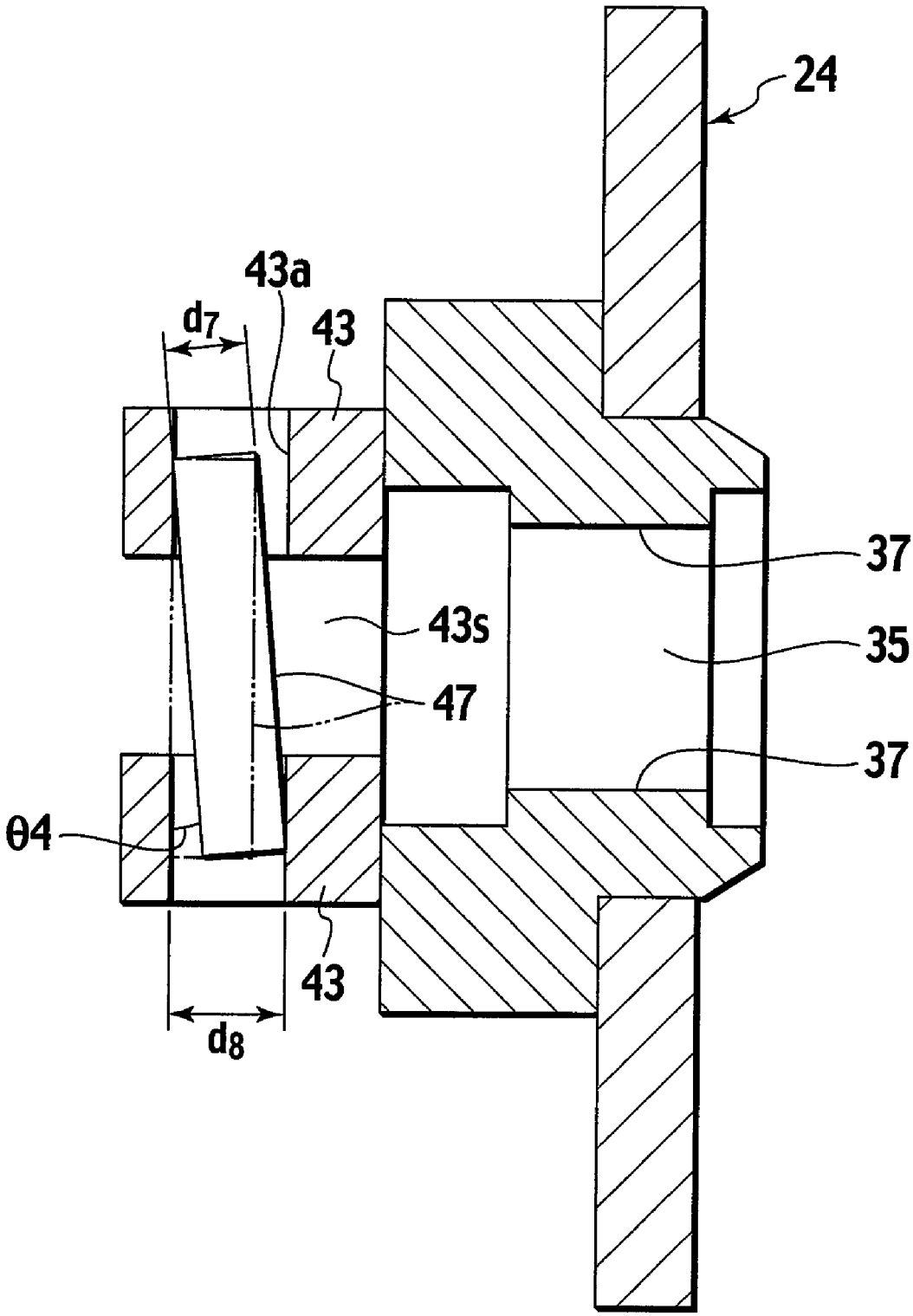
FIG. 11 is an explanatory view showing a maximum inclination angle θ4 of a second linking pin in a bearing clearance in a bearing hole for the second linking pin.
Figure 12:
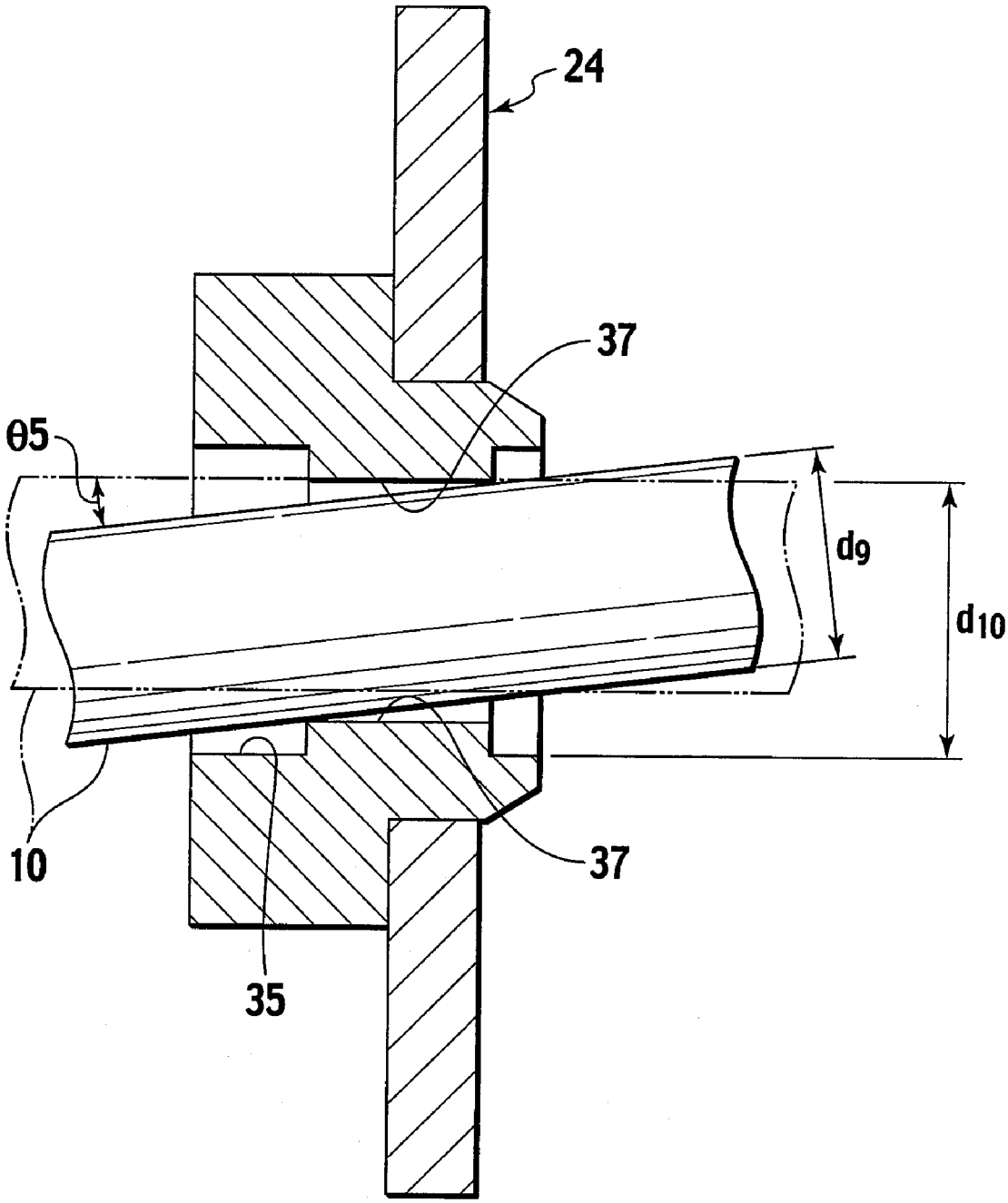
FIG. 12 is an explanatory view showing a maximum inclination angle θ5 of the drive shaft between a pair of opposite tilting guide faces of the tilting guide hole.
Figure 13:
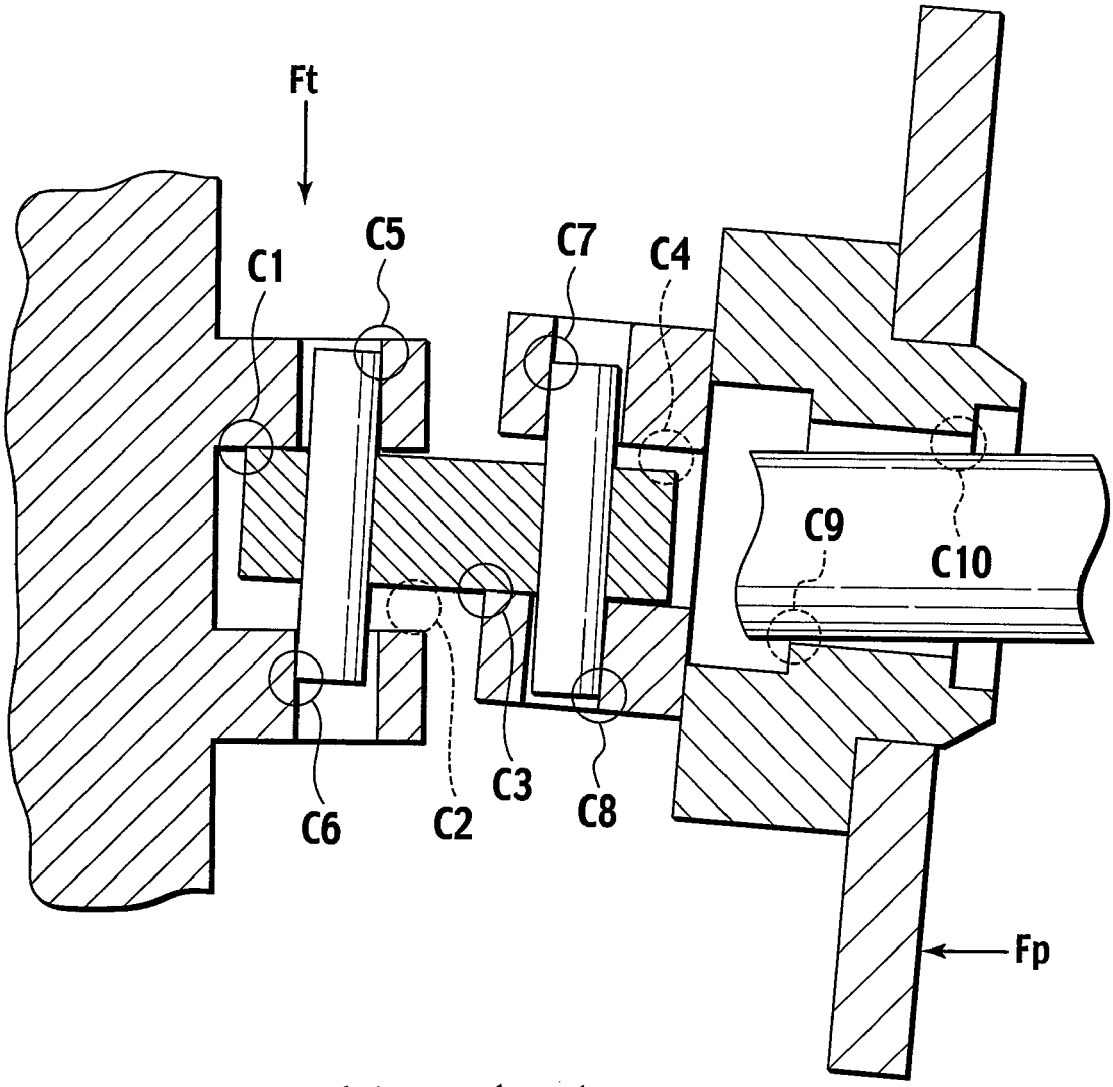
FIG. 13 is a cross sectional view of the link mechanism in a normal operation.
Figure 14:
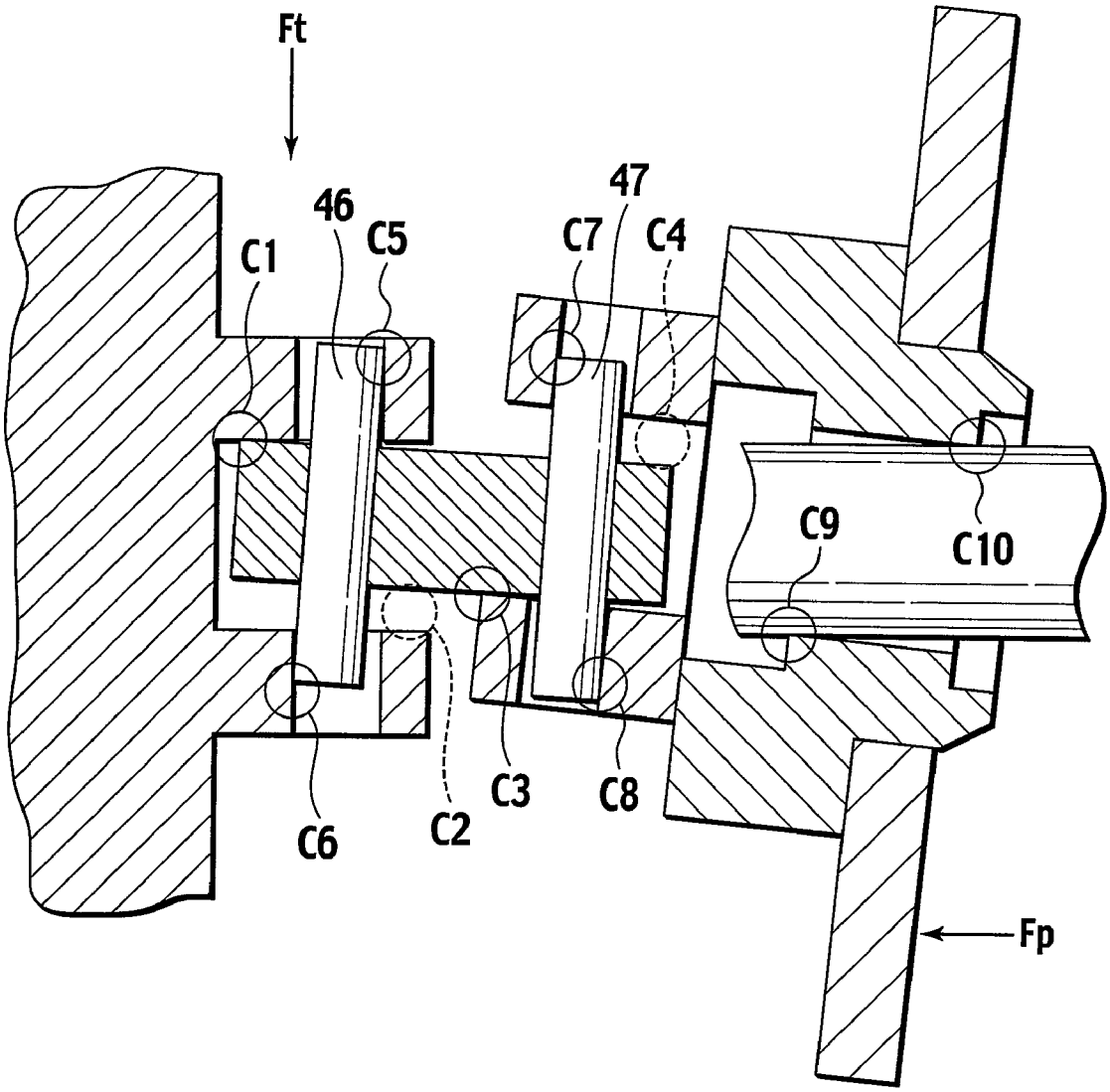
FIG. 14 is a cross sectional view of the link mechanism under an excessive compression reaction force.

FIG. 8 is an explanatory view showing a maximum inclination angle θ1 of a first end of the link member in the clearance between the pair of arms of the rotor; FIG. 9 is an explanatory view showing a maximum inclination angle θ2 of a second end of the link member in the clearance between the pair of arms of the swash plate; FIG. 10 is an explanatory view showing a maximum inclination angle θ3 of the first linking pin in the bearing clearance in the bearing hole for the first linking pin; FIG. 11 is an explanatory view showing a maximum inclination angle θ4 of the second linking pin in the bearing clearance in the bearing hole for the second linking pin; FIG. 12 is an explanatory view showing a maximum inclination angle θ5 of the second linking pin in the bearing clearance in the bearing hole for the second linking pin; FIG. 13 is a cross sectional view of the link mechanism in a normal operation; and FIG. 14 is a cross sectional view of the link mechanism under an excessive compression reaction force. Here, in FIGS. 7 to 16, the angles θ1 to θ5 and the width d1 to d10 are overly depicted for easy-to-understand explanation of the relations of the angles θ1 to θ5.

In pre-assembled condition, a degree of the maximum inclination angle of the link member 45 is determined, as the first maximum inclination angle θ1, by the clearance (d3-d1) between the slit 41*s* of the rotor 21 and the one end 45*a* of the link member 45 (FIG. 8); a degree of maximum inclination angle of the link member 45 is determined, as the second maximum inclination angle θ2, by the clearance (d4-d2) between the slit 43*s* of the swash plate 24 and the other end 45*b* of the link member 45 (FIG. 9); a degree of the maximum inclination angle of the first linking pin 46 is determined, as the third maximum inclination angle θ3, by the clearance (d6-d5) between the first linking pin 46 and the first bearing hole 41*a* (FIG. 10); a degree of the maximum inclination angle of the second linking pin 47 is determined, as the fourth maximum inclination angle θ4, by the clearance (d8-d7) between the second linking pin 47 and the second bearing hole 43*a* (FIG. 11); and a degree of the maximum inclination angle of the swash plate 24 with respect to the drive shaft 10 is determined, as the fifth maximum inclination angle θ5, by the clearance (d10-d9) between the drive shaft 10 and the pair of the tilting guide faces 37, 37 (FIG. 12). According to the present embodiment, the fifth maximum inclination angle θ5 is greater than the sum of the third maximum inclination angle θ3 and fourth maximum inclination angle θ4. In addition, the first maximum inclination angle θ1 and the second maximum inclination angle θ2 are greater than the fifth maximum inclination angle θ5 (See FIGS. 13 and 14). Those relations can be described as (θ3+θ4)<θ5<θ1, θ2.

Based on the relations, in the pre-assembled condition, relations θ3<θ1 and θ4<θ2 are established, and accordingly, the following relation is established when the link mechanism 40 is assembled.

In an assembled condition, the first maximum inclination angle θ1 and second maximum inclination angle θ2 have a relation as described below. As shown in FIG. 13, when the link member 45 rotates about an end C1, the link member 45 stops at an angle corresponding to the maximum inclination angle (θ3) of the first linking pin 46 that is allowed by the clearance (d6-d5) between the first linking pin 46 and the first bearing hole 41*a*. If the link member 45 rotated though the stop point to a point C2, a rotation angle of the link member 45 would be the first maximum inclination angle θ1. As shown in FIG. 2, when the link member 45 is rotates about a point C3, the link member 45 stops at an angle corresponding to the maximum inclination angle (θ4) of the second linking pin 47 that is allowed by the clearance (d8-d7) between the second linking pin 47 and the second bearing hole 43*a*. If the link member 45 rotated though the stop point to a point C4, a rotation angle of the link member 45 would be the second maximum inclination angle θ2.

In other words, as shown in FIG. 13, in the link mechanism 40 in the assembled condition, when the link member 45 is fully tilted within the clearance (d6-d5) between the first linking pin 46 and the bearing holes 41*a*, 41*a*, the link member 45 contacts only with one of the arms 41, not with the both arms 41, 41. That is, the link member 45 contacts with only a point (one of the points C1 and C2 in the figure).

As shown in FIG. 13, in the link mechanism 40 in the assembled condition, when the link member 45 is fully tilted within the clearance (d8-d7) between the second linking pin 47 and the bearing holes 43*a*, 43*a*, the link member 45 contacts only with one of the arms 43, not with the both arms 43, 43. That is, the link member 45 contacts with only a point (one of the points C3 or C4 in the figure).

According to the compressor of the present embodiment, which includes such relations, when the compressor is operative, a compression reaction force Fp is applied to the swash plate 24 as shown in FIGS. 6 and 13 and the swash plate 24 is leaned in a direction different from its inclination movement guided by the link mechanism 40, and then the linking pins 46, 47 is pressed against the inner faces of the bearing hole 41*a*, 43*a* and receives the compression reaction force Fp as shown in FIG. 13. The link member 45 is thus not pressed against the pair of arms 41, 41 at two points and against the pair of arms 43, 43 at two points so as not to be in a wedged state, unlike the conventional structure (Patent Document 1, for example).

Since the contact surfaces of the link member 45 and the arms 41 and the contact surfaces of the link member 45 and the arms 43 function as rotary torque transferring surfaces and also as rotary sliding surfaces, the controllability is much improved by preventing the wedged state found in the conventional structure.

When the compressor is operative, rapid changes in revolution of the drive shaft 10 or various changes in conditions of compressed fluid (such as refrigerant gas), which is sucked into the cylinder bores 3, can cause an instantaneous excessive compression reaction force.

When such an instantaneous excessive compression reaction force is generated and causes a flexure in at least one of the members constituting the link mechanism 40 (that is, at least one of the pair of arms 41, 41 of the rotor, pair of arms 43, 43 of the swash plate, link member 45, first linking pin 46, and second linking pin 47), the swash plate 24 can further be tilted with respect to the drive shaft 10. In this embodiment, the linking pins 46, 47, which have smallest cross-sectional area among the linking pins 46, 47, arms 41, arms 43, and link member 45, are mainly deformed.

Even though the swash plate 24 is further tilted like this, link member 45 does not contact with two points between the pair of arms 43, 43 of the swash plate 24 and with two point between the pair of arms 41, 41 of the rotor 21 due to the relation of θ3+θ4<θ5<θ1, θ2.

In other words, due to the relation of θ5<θ1, θ2, the drive shaft 10 contacts with two points (points C9 and C10 in the figures) on the pair of tilting guide faces 37, 37 when an excessive compression reaction force generated. The compression reaction force is thus supportively received in the tilting guide hole 35. With this structure, the link member 45 does not contact with two points between the between the pair of arms 43, 43 of the swash plate 24 and with two point between the pair of arms 41, 41 of the rotor 21 even when an excessive compression reaction force is applied. This prevents an increased sliding friction caused by a wedged state of the link member 45, so that the controllability of the compressor is maintained.

Here, even when the drive shaft 10 secondarily (supportively) contacts with tow points in the tilting guide hole 35, most of the compression reaction force is received by the linking pins 46, 47 and bearing holes 41*a*, 43*a* and this will hardly affect to the controllability.

Figure 15:
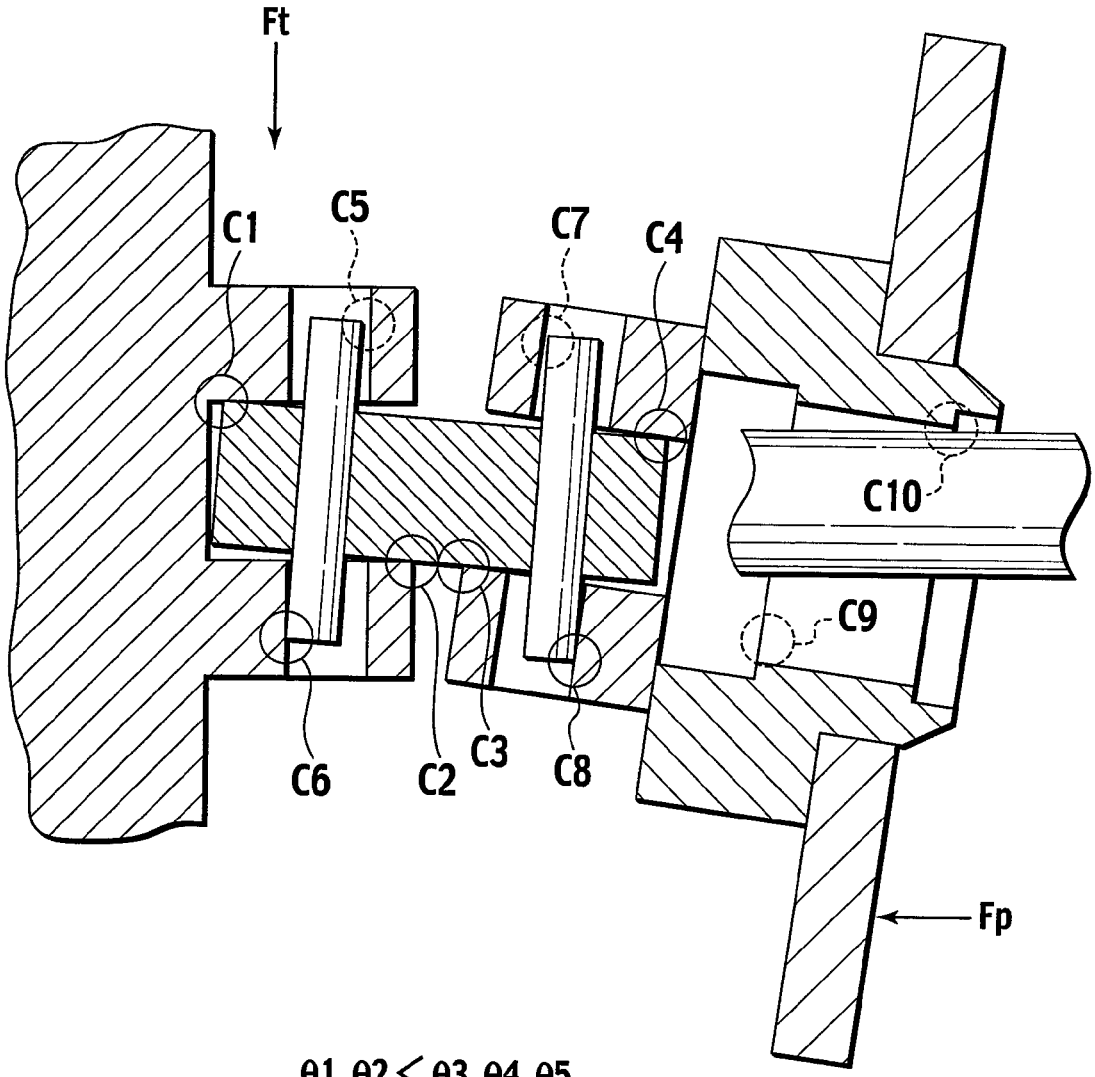
FIG. 15 is a cross sectional view of a first comparative link mechanism to be compared with the present invention.
Figure 16:
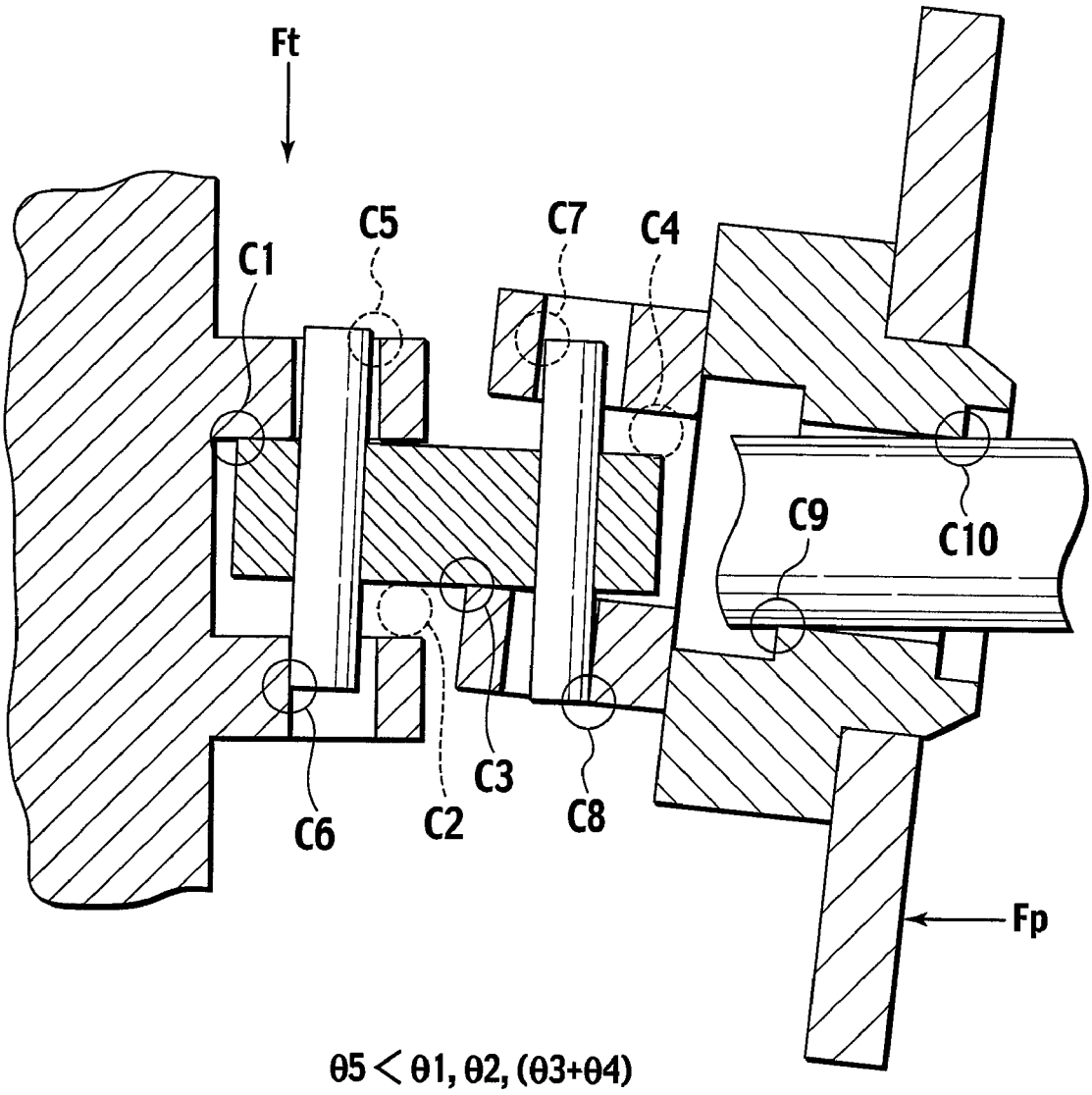
FIG. 16 is a cross sectional view of a second comparative link mechanism to be compared with the present invention.
Figure 17:
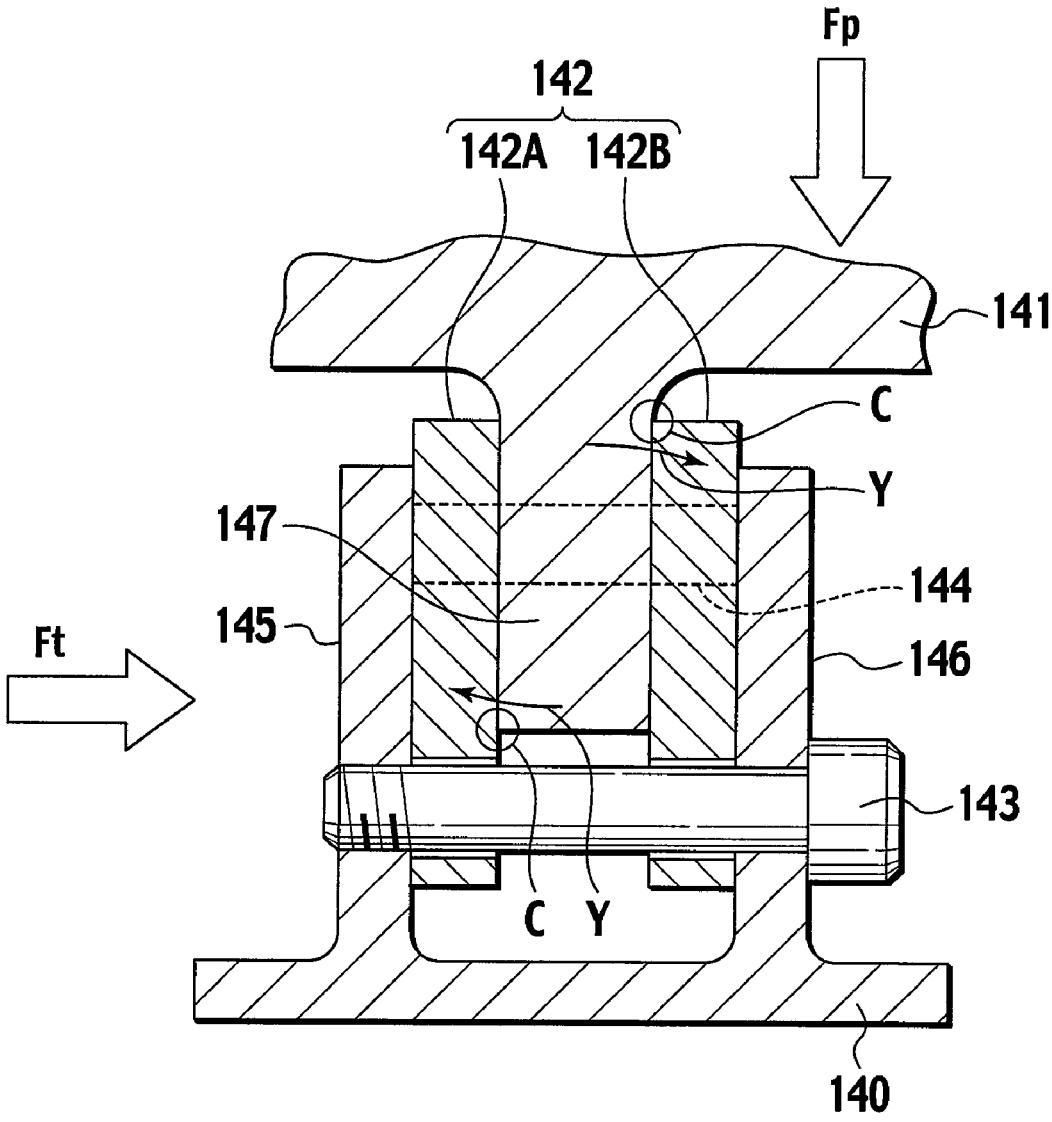
FIG. 17 is a view of a conventional link mechanism.

FIGS. 15 and 16 show examples compared with the present embodiment.

The comparative example 1 of FIG. 15 has a structure, in which a relation of θ1, θ2<θ3, θ4, θ5 is established. In this case, when the swash plate 24 leans out of its inclination movement due to a compression reaction force during a normal operation, the one end 45*a* of the link member 45 contacts with two points (points C1 and C2 in the figures) between the pair of arms 41, 41 of the rotor 21 and the other end 45*b* of the link member 45 contacts with two points (points C3 and C4 in the figures) between the pair of arms 43, 43 of the swash plate 24. Thus, the link member 45 can become wedged and the controllability describe in the present embodiment cannot be attained, according to the structure of the comparative example 1.

The comparative example 2 of FIG. 16 has a structure, in which a relation of θ5<θ1, θ2, (θ3+θ4) is established. In this case, when the swash plate 24 leans out of its inclination movement due to a compression reaction force during a normal operation, the drive shaft 10 contacts with two points (points C9 and C10 in FIG. 16) of the pair of the tilting guide faces 37, 37 and these two points receives all the compression reaction force Fp. A great degree of sliding friction is thus applied between the tilting guide faces 37, 37 and the drive shaft 10 when the swash plate 24 is tilted and the controllability describe in the present embodiment cannot be attained. However, the comparative example 2 has a better controllability compared to the comparative example 1 since the contact faces of the drive shaft 10 and tilting guide faces 37, 37 do not function as rotary torque transferring surfaces.

The above structure of the present embodiment provides the following effects.

(1) According to the present embodiment, when the swash plate 24 tilts due to a compression reaction force Fp during a normal operation, the compression reaction force Fp is received by the linking pins 46, 47 and the bearing holes 41*a*, 43*a*. In this structure, the one end 45*a* of the link member 45 contacts only with one of the pair of arms 41, 41, not with both the arms 41, 41 and the other end 45*b* of the link member 45 contacts only with one of the pair of arms 43, 43, not with both the arms 43, 43. With this structure, unlike the conventional structure (Patent Document 1, for example), the link member 35, which largely contributes to the torque transfer, does not be in a wedged state, so that the controllability of the compressor is improved.

(2) According to the present embodiment, when the swash plate 24 tilts with respect to the drive shaft 10 in a condition that an instantaneous excessive compression reaction force is generated and causes a flexure in at least one of the members constituting the link mechanism 40 (at least one of the members 41, 41, 43, 43, 45, 46, 47), the drive shaft 10 contacts with two points (C9 and C10) of the pair of tilting guide faces 37, 37 of the tilting guide hole 35, but the link member 45 does not contact with two points between the pair of arms 43, 43 of the swash plate 24 and the pair of arms 41, 41 of the rotor 21. In this structure, the compression reaction force can be supportively received in the tilting guide hole 35. An increased sliding friction caused by the wedged state of the link member 45 can be prevented and the controllability of the compressor is maintained, even when an excessive compression reaction force is applied.

(3) According to the present embodiment, the width d3 of the slit 41*s* between the arms 41, 41 of the rotor and the width d4 of the slit 43*s* between the arms 43, 43 of the swash plate are made the same. The link member 45 can be formed in a simple rectangular shape. The manufacturing cost of the link member 45 is substantially reduced since complicated cutting works and the like are not required to manufacture the link member 45. When the link member 45 is to be made of aluminum, an extrusion molding method and the like can be employed, for example.

(4) According to the present embodiment, the first linking pin 46 and second linking pin 47 have the same diameter and length. The manufacturing cost of the link mechanism 40 is substantially reduced since the same pin can be used for both the first linking pin 46 and second linking pin 47. For example, a die for manufacturing the first linking pin 46 and a die for manufacturing the second linking pin 47 can be shared and the number of required dies is reduced. Further, in the assembling process of the link mechanism 40, the first linking pins 46 and second linking pins 47 do not have to be prepared separately on a working table and this will reduce burden of assembly workers.

INDUSTRIAL APPLICABILITY

The present invention is not limited to the embodiment described above.

According to the above embodiment, the holes 41*a*, 41*a* provided in the rotor arms 41, 41 are bearing holes for pivotally supporting the first linking pin 46 and the hole 45*c* provided in the link member 45 is a fixing hole for fixing the first linking pin 46 therein. However, in the present invention, the holes 41*a*, 41*a* in the rotor arms 41, 41 can serve as fixing holes for fixing the first linking pin 46 by press fitting and the hole 45*c* in the link member 45 can serve as a bearing hole for pivotally supporting the first linking pin 46, for example.

The linking pins are fixed to the fixing holes by press fitting in the above embodiment; however, in the present invention, the linking pins can be fixed to the fixing holes by screws and the like.

In the present invention, the first linking pin can be integrally formed with the link member or the second linking pin can be integrally formed with the link member.

According to the above embodiment, the holes 43*a*, 43*a* provided in the swash plate arms 43, 43 are bearing holes for pivotally supporting the second linking pin 47 and the hole 45*c* provided in the link member 45 is a fixing hole for fixing the second linking pin 47 by press fitting therein. However, in the present invention, the holes 43*a*, 43*a* in the swash plate arms 43, 43 can serve as fixing holes for fixing the second linking pin 47 by press fitting and the hole 45*c* in the link member 45 can serve as a bearing hole for pivotally supporting the second linking pin 47.

According to the above embodiment, the width d1 of the slit 41*s* (the slit between the pair of arms 41, 41) of the rotor 21 and the width d2 of the slit 43*s* (the slit between the pair of arms 43, 43) of the swash plate 24 are formed the same and the link member 45 is formed in a rectangular shape. However, in the present invention, the width d1 of the slit 41*s* (between the pair of arms) of the rotor and the width d2 of the slit 43*s* (between the pair of arms) of the swash plate can differ or the width d1 of the one end 45*a* of the link member and the width d2 of the other end 45*b* of the link member can differ.

According to the above embodiment, the swash plate 24 is formed by combining the swash plate body 26 and the hub 25, which are separately provided. However, in the present invention, a swash plate 24, which is previously formed as a single-piece, can be employed, for example.

According to the above embodiment, a rotary swash plate is used; however, the present invention can employ a wobble plate (irrotational swash plate).

The present invention can be implemented with various modifications without departing from the technical scope of the present invention.

The invention claimed is:

1. A variable capacity compressor comprising:

a drive shaft;

a rotating member fixed to the drive shaft and configured to rotate integrally with the drive shaft;

a tilting member having a tilting guide hole formed with a pair of opposite tilting guide faces and tiltably attached to the drive shaft;

a link mechanism configured to transfer a rotary torque of the rotating member to the tilting member allowing the tilting member to tilt; and a piston configured to reciprocate in response to rotation of the tilting member, wherein the link mechanism comprises:

a pair of opposite arms extending from the rotating member toward the tilting member;

a pair of opposite arms extending from the tilting member toward the rotating member;

a link member having a first end that is inserted between the arms of the rotating member and a second end that is inserted between the arms of the tilting member, a first linking pin pivotally connecting the first end of the link member and the arms of the rotating member; and a second linking pin pivotally connecting the second end of the link member and the arms of the tilting member, wherein a first maximum inclination angle is a maximum angle of the first end of the link member between the pair of the arms of the rotating member in pre-assembled condition, a second maximum inclination angle is a maximum angle of the second end of the link member between the pair of the arm of the tilting member in pre-assembled condition, a third maximum inclination angle is a maximum angle of the first linking pin in a bearing clearance in a bearing hole for the first linking pin in pre-assembled condition, a fourth maximum inclination angle is a maximum angle of the second linking pin in a bearing clearance in a bearing hole for the second linking pin in pre-assembled condition, and a fifth maximum inclination angle is a maximum angle of the drive shaft between the pair of the opposite tilting guide surfaces in pre-assembled condition, and wherein each of the first maximum inclination angle and the second maximum inclination angle is larger than the fifth maximum inclination angle, and the fifth maximum inclination angle is larger than a sum of the third maximum inclination angle and the fourth maximum inclination angle.

* * * * *